US005788132A

United States Patent [19]

Kuruc, Jr.

[11] Patent Number: 5,788,132

[45] Date of Patent: Aug. 4, 1998

[54] ARTICLE HOLDER STRAP APPARATUS

[76] Inventor: Robert J. Kuruc, Jr., 171 Rte. 66, Apollo, Pa. 15613

[21] Appl. No.: 797,139

[22] Filed: Feb. 10, 1997

[51] Int. Cl.[6] ..... A45F 3/14

[52] U.S. Cl. ..... 224/250; 224/268; 224/269; 24/199

[58] Field of Search ..... 224/250, 257, 224/258, 600–604, 606, 623–627, 637–648, 650, 651, 915, 184, 268, 269, 579, 621, 910, 931, 914; 24/3.12, 199

[56] References Cited

U.S. PATENT DOCUMENTS

| | | | |
|---|---|---|---|
| 37,203 | 12/1862 | Short . | |
| D. 314,277 | 2/1991 | Hackley | 224/250 |
| 4,605,143 | 8/1986 | Parker | 224/650 |
| 4,771,927 | 9/1988 | Ventura . | |
| 4,848,625 | 7/1989 | Lucia . | |
| 5,238,162 | 8/1993 | LaCivita . | |
| 5,370,286 | 12/1994 | Newman . | |
| 5,437,399 | 8/1995 | Levitt et al. | 224/269 |
| 5,642,842 | 7/1997 | Taras | 224/250 |

*Primary Examiner*—Henry J. Recla
*Assistant Examiner*—Timothy L. Maust

[57] ABSTRACT

An article holder apparatus includes a flexible strap member which has a longitudinal strap axis. A loop retention assembly is connected to the flexible strap member for maintaining the flexible strap member in a loop configuration. A clip assembly is connected to the flexible strap member. The clip assembly has a longitudinal clip axis. A strap guide is connected to the clip assembly for receiving a portion of the flexible strap member and for orienting the longitudinal strap axis in parallel with the longitudinal clip axis. The loop retention assembly includes female lock member connected to a first end of the flexible strap member and a complimentary male lock member connected to a second end of the flexible strap member. The loop retention assembly further includes a loop-size adjustment assembly. The loop-size adjustment assembly includes an exterior frame portion and a transverse rib member extending across two portions of the exterior frame portion. The clip assembly includes a base portion and a clip portion supported by the base portion. The clip portion is resilient and is biased towards the base portion. The clip portion includes a rap-lock member projecting toward the base portion. The clip portion includes a handle portion projecting away from the base portion. The strap guide includes a pair of guide slots located at opposite ends of the base portion along the longitudinal clip axis.

5 Claims, 2 Drawing Sheets

FIG 1
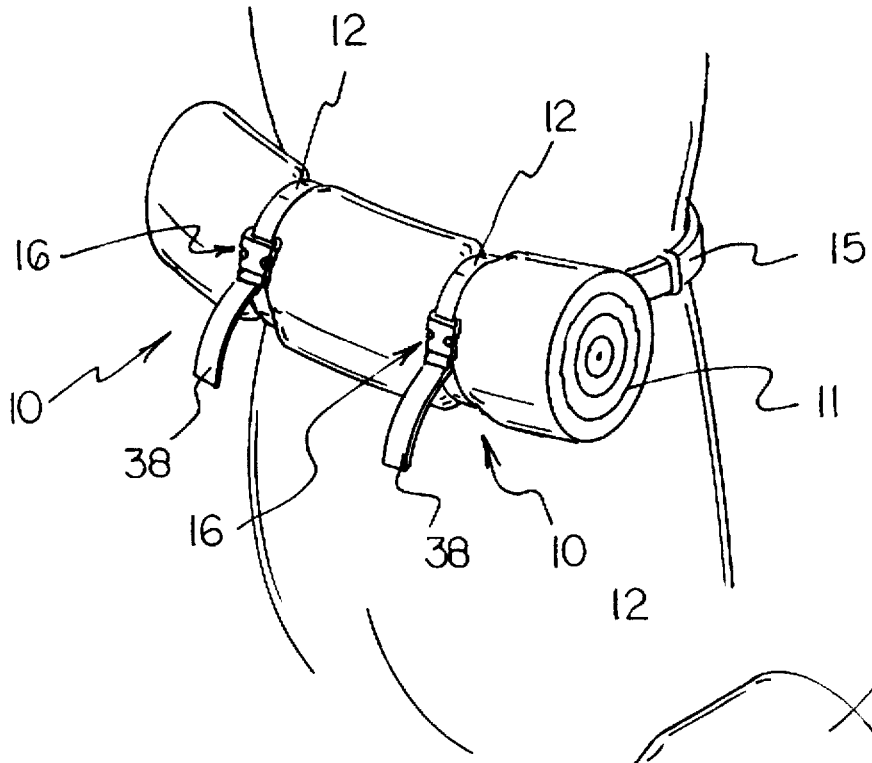
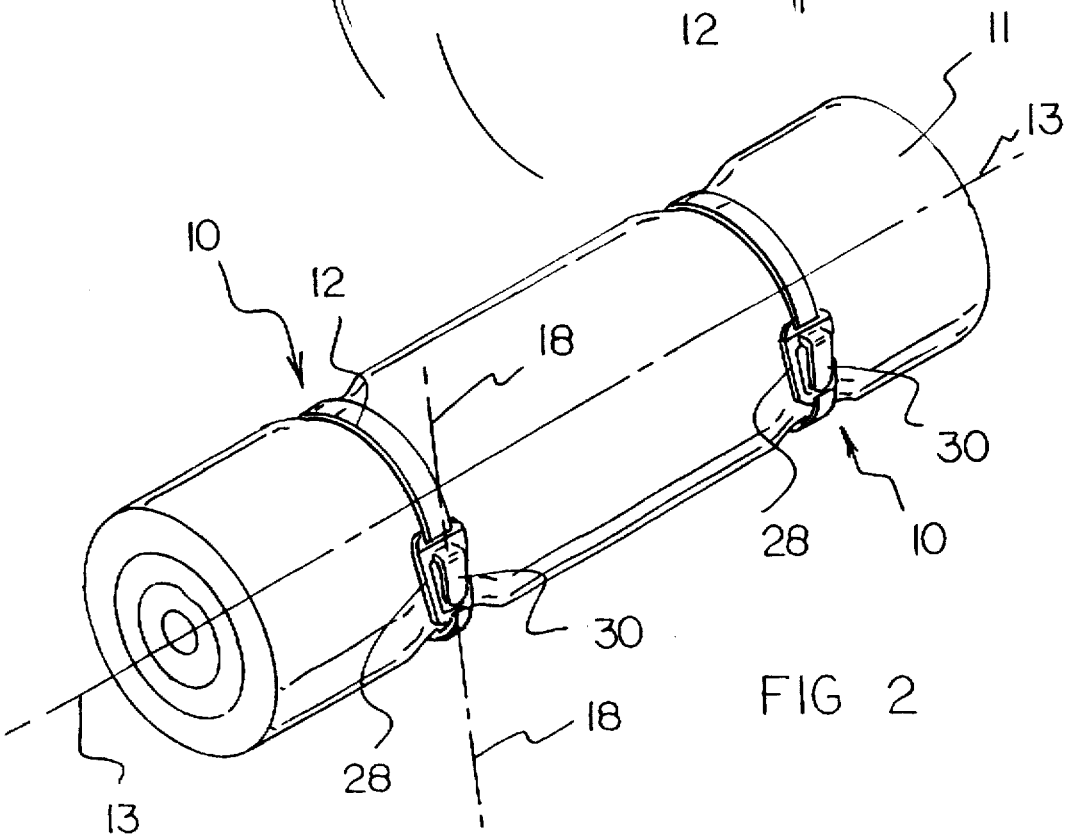
FIG 2

ARTICLE HOLDER STRAP APPARATUS

BACKGROUND OF THE INVENTION

1. Field of the Invention

The present invention relates generally to devices for carrying articles and, more particularly, to article carriers that employ adjustable straps.

2. Description of the Prior Art

The use of straps for carrying articles is well known. More specifically, throughout the years, a number of innovations have been developed relating to carrying articles with the use or straps, and the following U.S. Pat. Nos. are representative of some of those innovations: 37,203, 4,771,927, 4,848,625, 5,238,162, and 5,370,286. More specifically, U.S. Pat. No. 37,203 discloses a strap attached to a harness for carrying a rolled-up article, such as a blanket. The harness is worn on a person's torso or on a backpack. For convenience, however, it would be desirable if a strap device for carrying an article could be worn on a person's belt.

With respect to being belt attached, each of U.S. Pat. Nos. 4,771,927 and 4,848,625 discloses an article holder strap device that is worn on a person's belt. With each device, however, the longitudinal axis of the strap and the longitudinal axis of the belt attachment device are at right angles to each other. As a result, it is difficult to carry an article such that the longitudinal axis of the article is parallel with the longitudinal axis of the person's belt. In this respect, it would be desirable if an article holder device were provided in which the longitudinal axis of the strap and the longitudinal axis of the belt attachment device are parallel to each other. In addition, it would be desirable if an article holder device were provided in which it is easy to carry an article such that the longitudinal axis of the article is parallel to the longitudinal axis of the person's belt.

U.S. Pat. Nos. 5,238,162 and 5,370,286 may be of interest for their of disclosure of additional article holder strap devices.

Still other features would be desirable in an article holder strap apparatus. For example, once the apparatus is attached to a belt, it would be desirable if the strap were readily adjustable to accommodate articles of different sizes. In addition, when a belt attachment device is employed, to assure that the attachment device does not slip off of the belt, it would be desirable if a provision were made on the device to secure the device to the belt.

Thus, while the foregoing body of prior art indicates it to be well known to use devices to carry articles using straps, the prior art described above does not teach or suggest an article holder strap apparatus which has the following combination of desirable features: (1) is worn on a person's belt; (2) provides that the longitudinal axis of a strap and the longitudinal axis of a belt attachment device are parallel to each other; (3) facilitates carrying an article such that the longitudinal axis of the article is parallel to the longitudinal axis of the person's belt; (4) permits the strap to be readily adjustable to accommodate articles of different sizes; and (5) has a provision for securing the apparatus to a belt. The foregoing desired characteristics are provided by the unique article holder strap apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an article holder apparatus which includes a flexible strap member which has a longitudinal strap axis. A loop retention assembly is connected to the flexible strap member for maintaining the flexible strap member in a loop configuration. A clip assembly is connected to the flexible strap member. The clip assembly has a longitudinal clip axis. A strap guide is connected to the clip assembly for receiving a portion of the flexible strap member and for orienting the longitudinal strap axis in parallel with the longitudinal clip axis.

The loop retention assembly includes a first retention member connected to a first end of the flexible strap member and a complimentary second retention member connected to a second end of the flexible strap member. The first retention member is a female lock member and the second retention member is a complementary male lock member. The loop retention assembly further includes a loop-size adjustment assembly. The loop-size adjustment assembly includes an exterior frame portion and a transverse rib member extending across two portions of the exterior frame portion.

The clip assembly includes a base portion and a clip portion supported by the base portion. The clip portion is resilient and is biased towards the base portion. The clip portion includes a strap-lock member projecting toward the base portion. The clip portion includes a handle portion projecting away from the base portion. The strap guide includes a pair of guide slots located at opposite ends of the base portion along the longitudinal clip axis.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved article holder strap apparatus which has all of the advantages of the prior art and none of the disadvantages.

It is another object of the present invention to provide a new and improved article holder strap apparatus which may be easily and efficiently manufactured and marketed.

It is a further object of the present invention to provide a new and improved article holder strap apparatus which is of durable and reliable construction.

An even further object of the present invention is to provide a new and improved article holder strap apparatus which is susceptible of a low cost of manufacture with regard to both materials and labor, and which accordingly is then susceptible of low prices of sale to the consuming public, thereby making such article holder strap apparatus available to the buying public.

Still yet a further object of the present invention is to provide a new and improved article holder strap apparatus which is worn on a person's belt.

Still another object of the present invention is to provide a new and improved article holder strap apparatus that provides that the longitudinal axis of a strap and the longitudinal axis of a belt attachment device are parallel to each other.

Yet another object of the present invention is to provide a new and improved article holder strap apparatus which facilitates carrying an article such that the longitudinal axis of the article is parallel to the longitudinal axis of the person's belt.

Even another object of the present invention is to provide a new and improved article holder strap apparatus that permits the strap to be readily adjustable to accommodate articles of different sizes.

Still a further object of the present invention is to provide a new and improved article holder strap apparatus which has a provision for securing the apparatus to a belt.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a rear perspective view showing a pair of preferred embodiments of the article holder strap apparatus of the invention in use carrying and article and being supported on a person's belt.

FIG. 2 is an enlarged front perspective view of the pair of article holder strap apparatuses of FIG. 1 removed from the person's belt.

DESCRIPTION OF THE PREFERRED EMBODIMENT

With reference to the drawings, a new and improved article holder strap apparatus embodying the principles and concepts of the present invention will be described.

Figure 3:
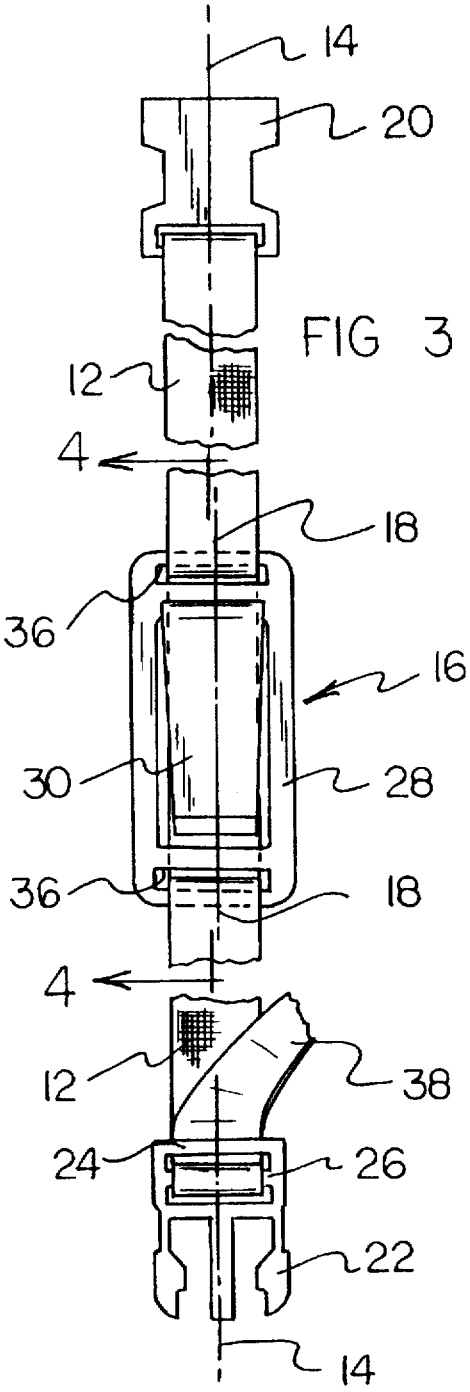
FIG. 3 is a top view of an individual embodiment of the article holder strap apparatus of FIG. 2 with the article removed and the apparatus unbuckled.
Figure 4:
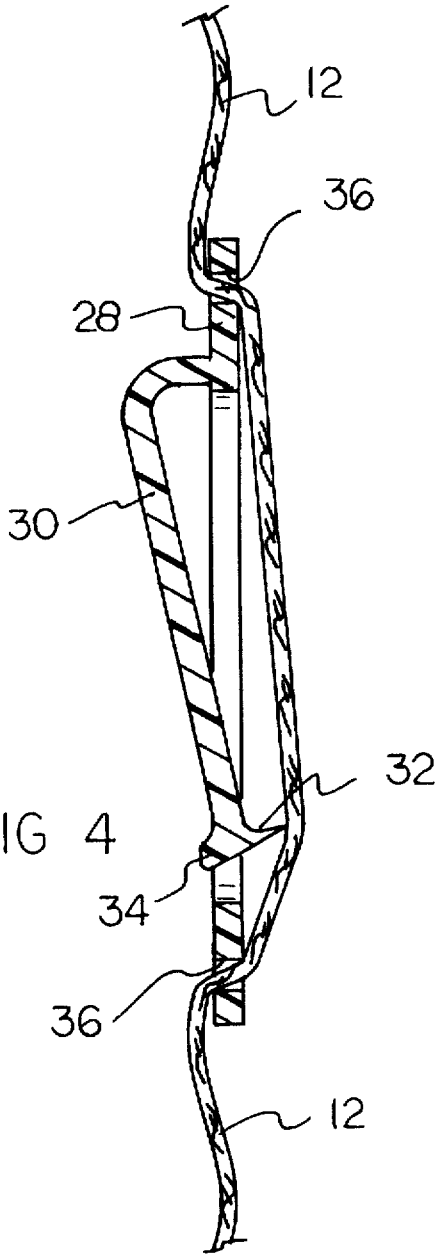
FIG. 4 is an enlarged cross-sectional view of the portion of the embodiment of the invention in FIG. 3 taken along line 4–4 thereof.

Turning to FIGS. 1–4, there is shown a pair of exemplary embodiments of the article holder strap apparatus of the invention generally designated by reference numeral 10. In its preferred form, article holder strap apparatus 10 includes a flexible strap member 12 which has a longitudinal strap axis 14. A loop retention assembly is connected to the flexible strap member 12 for maintaining the flexible strap member 12 in a loop configuration. A clip assembly 16 is connected to the flexible strap member 12. The clip assembly 16 has a longitudinal clip axis 18. A strap guide is connected to the clip assembly 16 for receiving a portion of the flexible strap member 12 and for orienting the longitudinal strap axis 14 in parallel with the longitudinal clip axis 18.

The loop retention assembly includes a first retention member 20 connected to a first end of the flexible strap member 12 and a complimentary second retention member 22 connected to a second end of the flexible strap member 12. The first retention member 20 is a female lock member 20 and the second retention member 22 is a complementary male lock member 22. The loop retention assembly further includes a loop-size adjustment assembly. The loop-size adjustment assembly includes an exterior frame portion 24 and a transverse rib member 26 extending across two portions of the exterior frame portion 24.

The clip assembly 16 includes a base portion 28 and a clip portion 30 supported by the base portion 28. The clip portion 30 is resilient and is biased towards the base portion 28. The clip portion 30 includes a strap-lock member 32 projecting toward the base portion 28. The clip portion 30 includes a handle portion 34 projecting away from the base portion 28. The strap guide includes a pair of guide slots 36 located at opposite ends of the base portion 28 along the longitudinal clip axis 18.

To use article holder apparatuses 10 of the invention, a pair of the article holder apparatuses 10 is obtained. The clip portion 30 of each clip assembly 16 is pulled partially away from the base portion 28 and is placed in connection with a belt 15 worn by a person. Then, the clip portion 30 is released, allowing the clip portion 30 to engage the belt 15. The pair of article holder apparatuses 10 are spaced apart on the belt 15 to accommodate the longitudinal length of an article 11 to be carried. On each article holder apparatus 10, the respective male lock member 22 is unlocked from the female lock member 20. The article 11 to be carried can be a wide variety of items includes a coat, sweater, shirt, jacket, or the like. As shown in the drawings, the article 11 is rolled up into a generally cylindrical shape which has a longitudinal article axis 13. A first portion of the rolled up article 11 is placed in contact with the clip assembly 16 of a first of the pair of article holder apparatuses 10. The male lock member 22 of the first article holder apparatus 10 is then is connected to the female lock member 20 of the first article holder apparatus 10. Then, a second portion of the rolled up article 11 is placed in contact with the clip assembly 16 of the second of the pair of article holder apparatuses 10. Then, the male lock member 22 of the second article holder apparatus 10 is connected to the female lock member 20 of the second article holder apparatus 10. By following this procedure, the article 11 is supported by the pair of article holder apparatuses 10 of the invention.

To assure that the article 11 is retained securely in the article holder apparatuses 10, the length of the each flexible strap member 12 is adjusted by pulling on the free end 38 of the flexible strap member 12 so that the flexible strap member 12 is adjusted with respect to the transverse rib member 26 and the exterior frame portion 24 of the loop-size adjustment assembly. Although two article holder apparatuses 10 of the invention are shown in use with one article 11, any desired number of apparatuses can be used. Relatively small items may need only one article holder apparatus 10. Relatively large or heavy items may need two, three, or more article holder apparatuses 10.

The adjustment of the effective size of the loop of the flexible strap member 12 is not the only adjustment that can be made with the article holder apparatus 10 of the invention. In addition, the position of the clip assembly 16 on the flexible strap member 12 can be adjusted. More specifically, the clip assembly 16 can be slid along the flexible strap member 12 using the guide slots 36 in the base portion 28 of the clip assembly 16.

When the clip assembly 16 is attached to a belt 15, the strap-lock member 32 fits under the belt 15 and secures the clip assembly 16 to the belt 15. To remove the clip assembly 16 from the belt 15, the handle portion 34 of the clip portion 30 can be grasped to pull the clip portion 30 away from the belt 15, whereby the strap-lock member 32 disengages from the belt 15.

The flexible strap member 12 can be made from a wide variety of materials, and nylon is especially suitable. Preferably, the flexible strap member 12 is in a form of woven web material. The article holder apparatus 10 can be made in a wide variety of colors, ranging from conservative to flamboyant. One model of the article holder apparatus 10 can employ a flexible strap member 12 made from a relatively light weight nylon material. Such light weight model can be employed for summer use where articles of clothing are generally light weight. Another model can employ a heavier weight nylon material. The heavier weight model can be used for winter for which articles of clothing are heavier weight.

The article holder apparatus 10 of the invention offers hikers, walkers, joggers, and the like a hands-free way to carry along articles. When the carried article is to be used, it is simply removed from the article holder apparatus 10 of the invention and worn.

The components of the article holder strap apparatus of the invention can be made from inexpensive and durable fabric, metal, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved article holder strap apparatus that is low in cost, relatively simple in design and operation, and which may advantageously be worn on a person's belt. With the invention, an article holder strap apparatus provides that the longitudinal axis of a strap and the longitudinal axis of a belt attachment device are parallel to each other. With the invention, an article holder strap apparatus is provided which facilitates carrying an article such that the longitudinal axis of the article is parallel to the longitudinal axis of the person's belt. With the invention, an article holder strap apparatus is provided which permits the strap to be readily adjustable to accommodate articles of different sizes. With the invention, an article holder strap apparatus is provided which has a provision for securing the apparatus to a belt.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An article holder apparatus, comprising:

a flexible strap member which has a longitudinal strap axis and which includes first and second opposed free ends, a loop retention assembly connected to said flexible strap member for selectively connecting said first and second free ends and for maintaining said flexible strap member in a loop configuration, and a clip assembly connected to said flexible strap member intermediate of said first and second free ends thereof, wherein said clip assembly has a longitudinal clip axis, said clip assembly including strap guide means for receiving a portion of said flexible strap member and for adjustably orienting said longitudinal strap axis in parallel with said longitudinal clip axis, said clip assembly comprising a base portion, a clip portion carried on said base portion, and said strap guide means comprising first and second spaced openings in said base portion oriented in transverse relation to said clip axis, said clip portion being located intermediate said first and second spaced openings such that said flexible strap is adapted to extend through said first and second transverse openings in a juxtaposed manner relative to said clip portion and be selectively slidably positioned relative to said clip portion along said longitudinal clip axis, said clip portion having a first end attached to said base portion proximal to said first opening in said base portion and having a second distal free end extending toward said second opening in said base portion, wherein said loop retention assembly includes a first retention member connected to said first free end of said flexible strap member and a complimentary second retention member connected to said second end of said flexible strap member, and wherein said loop retention assembly further includes a loop-size adjustment assembly, said loop-size adjustment assembly includes an exterior frame portion connected to said first retention member, said exterior frame portion comprising a transverse rib member extending across two opposed portions of said exterior frame portion to define first and second transverse passages on opposed sides of said rib member such that said first end of said flexible strap member is adapted to slidably extend through said first transverse passage around said rib member and back through said second transverse passage whereby said retention member is slidably adjustable on said flexible strap member proximal to said first free end thereof.

2. The apparatus of claim 1 wherein said first retention member is a female lock member and said second retention member is a complementary male lock member.

3. The apparatus of claim 1 wherein said clip portion is resilient and is biased towards said base portion.

4. The apparatus of claim 1 wherein said clip portion at said distal free end includes a strap-lock member projecting toward said base portion.

5. The apparatus of claim 1 wherein said clip portion at said distal free end includes a handle portion projecting away from said base portion.

* * * * *